US011330861B2

(12) United States Patent
Dahl et al.

(10) Patent No.: US 11,330,861 B2
(45) **Date of Patent: *May 17, 2022**

(54) VOID CELL ARRANGEMENTS WITH DIFFERING VOID CELLS

(71) Applicant: SKYDEX TECHNOLOGIES, INC., Centennial, CO (US)

(72) Inventors: Jerod Dahl, Centennial, CO (US); Peter Foley, Castle Rock, CO (US); Collin Metzer, Highlands Ranch, CO (US); Trevor Kanous, Denver, CO (US); Eric William Sugano, Denver, CO (US)

(73) Assignee: SKYDEX TECHNOLOGIES, INC., Centennial, CO (US)

( * ) Notice: Subject to any disclaimer, the term of this patent is extended or adjusted under 35 U.S.C. 154(b) by 130 days.

This patent is subject to a terminal disclaimer.

(21) Appl. No.: 16/818,940

(22) Filed: Mar. 13, 2020

(65) Prior Publication Data

US 2020/0214391 A1 Jul. 9, 2020

Related U.S. Application Data

(63) Continuation of application No. 14/445,752, filed on Jul. 29, 2014, now Pat. No. 10,624,419.

(60) Provisional application No. 61/861,514, filed on Aug. 2, 2013.

(51) Int. Cl.
*A43B 13/20* (2006.01)
*A43B 13/18* (2006.01)

(52) U.S. Cl.
CPC ..... *A43B 13/181* (2013.01); *A43B 13/186* (2013.01); *A43B 13/189* (2013.01); *A43B 13/20* (2013.01)

(58) Field of Classification Search
CPC ... A43B 13/181; A43B 13/186; A43B 13/189; A43B 13/20; A43B 1/009; A43B 1/0018; A43B 7/32
USPC ..... 36/25 R, 28, 29
See application file for complete search history.

(56) References Cited

U.S. PATENT DOCUMENTS

| | | | |
|---|---|---|---|
| 2,748,401 | A | 6/1956 | Winstead |
| 2,968,105 | A | 1/1961 | Rizzo |
| 3,030,640 | A | 4/1962 | Gosman |
| 3,251,076 | A | 5/1966 | Burke |
| 4,167,598 | A | 9/1979 | Logan |
| 4,535,553 | A | 8/1985 | Derderian et al. |
| 4,891,855 | A | 1/1990 | Cheng-Chung |

(Continued)

FOREIGN PATENT DOCUMENTS

| | | | |
|---|---|---|---|
| WO | 9111931 | A1 | 8/1991 |
| WO | 0170064 | A2 | 9/2001 |
| WO | 0231377 | A2 | 4/2002 |

OTHER PUBLICATIONS

International Searching Authority, U.S. Patent and Trademark Office, International Search Report and Written Opinion for PCT/US2014/048690; dated Nov. 26, 2014.

*Primary Examiner* — Katharine G Kane
(74) *Attorney, Agent, or Firm* — Holzer Patel Drennan

(57) ABSTRACT

A shoe sole comprises a first array of interconnected void cells that is oriented adjacent to a second opposing array of interconnected void cells, wherein the second opposing array of interconnected void cells is geometrically different from the first array of void cells and includes at least one void cell with an asymmetrical perimeter.

18 Claims, 5 Drawing Sheets

(56) References Cited

U.S. PATENT DOCUMENTS

| | | | | |
|---|---|---|---|---|
| 4,999,931 | A | 3/1991 | Vermeulen | |
| 5,311,674 | A | 5/1994 | Santiyanont et al. | |
| 5,337,492 | A * | 8/1994 | Anderie ..... | A43B 13/181 36/114 |
| 5,572,804 | A | 11/1996 | Skaja et al. | |
| 5,976,451 | A | 11/1999 | Skaja et al. | |
| 6,029,962 | A | 2/2000 | Shorten et al. | |
| 6,098,313 | A | 8/2000 | Skaja | |
| 6,385,864 | B1 | 5/2002 | Sell, Jr. et al. | |
| 6,571,490 | B2 | 6/2003 | Tawney | |
| 6,777,062 | B2 | 8/2004 | Skaja | |
| 6,931,764 | B2 | 8/2005 | Swigart et al. | |
| 7,707,743 | B2 | 5/2010 | Schindler et al. | |
| 7,754,312 | B2 | 7/2010 | Nakajima | |
| 7,810,255 | B2 | 10/2010 | Schindler | |
| 8,056,263 | B2 | 11/2011 | Schindler et al. | |
| 8,069,498 | B2 | 12/2011 | Maddux et al. | |
| 8,178,022 | B2 | 5/2012 | Schindler et al. | |
| 8,328,279 | B2 | 12/2012 | Brncick et al. | |
| 8,713,716 | B2 | 5/2014 | Krueger | |
| 8,714,071 | B2 | 5/2014 | Foley et al. | |
| 8,827,371 | B2 | 9/2014 | Bmcick | |
| 8,904,584 | B2 | 12/2014 | Sugano | |
| 8,943,709 | B2 | 2/2015 | Aveni | |
| 2007/0119074 | A1 | 5/2007 | Aveni | |
| 2009/0211114 | A1 | 8/2009 | Ivester | |
| 2010/0176633 | A1 | 7/2010 | Brncick et al. | |

* cited by examiner

VOID CELL ARRANGEMENTS WITH DIFFERING VOID CELLS

CROSS-REFERENCE TO RELATED APPLICATIONS

The present application claims benefit of priority to U.S. Provisional Pat. App. No. 61/861,514 entitled "Offset Cut Lines" and filed on Aug. 2, 2013, which is specifically incorporated by reference for all that it discloses. The present application is further a continuation of U.S. patent application Ser. No. 14/445,752 entitled "Differing Void Cell Matrices for Sole Support" and filed on Jul. 29, 2014, which is also specifically incorporated by reference herein for all that it discloses.

BACKGROUND

Void cell arrangements may be used for cushioning and/or support applications, specifically apparel. For example, a void cell arrangement may be used to form all or a portion of a shoe sole. In some implementations, layers of identical void cells are stacked. However, stacked layers of identical void cells may not provide varying degrees of compression and rebound characteristics as well as cushioning characteristics in different areas of the shoe sole.

SUMMARY

Implementations described and claimed herein address the foregoing by providing a shoe sole with differing stacked arrays of void cells. The shoe sole includes a first array of interconnected void cells adjacent to a second opposing array of interconnected void cells. The second opposing array of interconnected void cells is geometrically different from the first array of interconnected void cells and includes at least one void cell with an asymmetrical perimeter.

BRIEF DESCRIPTIONS OF THE DRAWINGS

DETAILED DESCRIPTIONS

Arrangements of void cells can be used in apparel to provide for varying degrees of protection, mobility, and stability, and cushioning. Void cell arrangements with a variety of structural and functional features are described in detail below. Some implementations of the disclosed technology include cell arrangements that utilize multiple arrays of void cells attached to one another and having different individual void cell geometries. While FIGS. 1-5 specifically illustrate shoe soles, the arrangements of void cells disclosed herein may be applied to other cushioning apparel.

Figure 1:
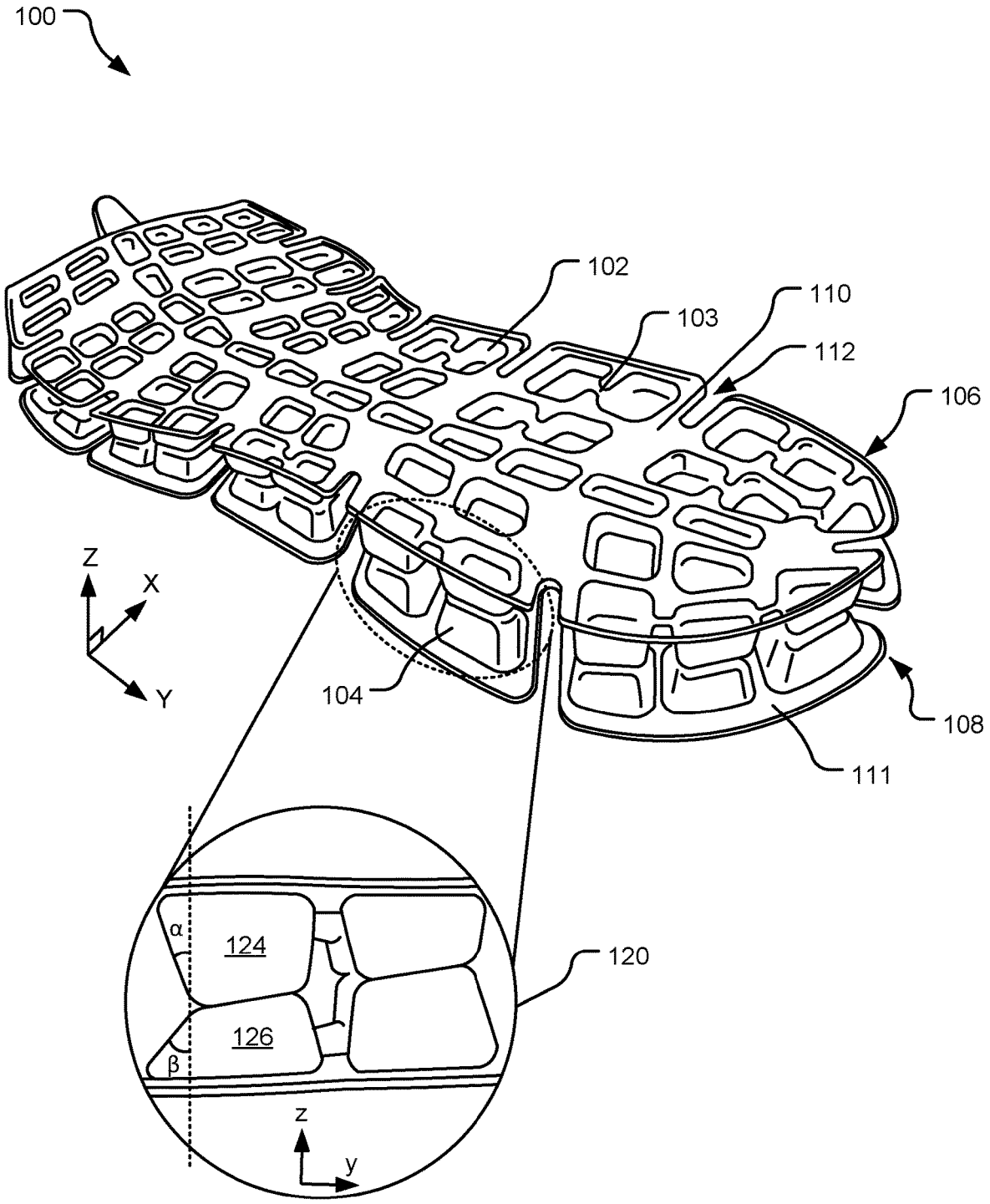
FIG. 1 illustrates a perspective view of an example shoe sole including void cells arranged in geometrically different void cell matrices.

FIG. 1 illustrates a perspective view of an example shoe sole 100 including void cells (e.g., void cells 102, 104) arranged in geometrically different void cell matrices. In particular, the shoe sole 100 includes a top matrix 106 and a bottom matrix 108, each including a plurality of void cells. The void cells are hollow chambers that resist deflection due to compressive forces, similar to compression springs. The void cells of the top matrix 106 protrude from a common top binding layer 110 and the void cells of the bottom matrix 108 protrude from a common bottom binding layer 111. The binding layers 110, 111 may be constructed with the same materials as the void cells and may be contiguous with the void cells.

The individual void cells may or may not be arranged in a grid-like pattern. Some of the void cells in the top matrix 106 align with corresponding void cells in the bottom matrix 108. The term "corresponding cells" or "opposing cells" refers to a pairing of void cells with peaks axially aligned along an axis substantially perpendicular (e.g., +/−5°) to a surface supporting the shoe sole 100 (e.g., an axis in the z-direction, as shown in FIG. 1). Alignment along an axis in the z-direction, as illustrated, is also referred to herein as "vertical alignment."

The top matrix 106 and the bottom matrix 108 are geometrically different from one another. Opposing cells in the bottom matrix 108 and the top matrix 106 may or may not be identical in shape, size, and/or relative placement within an x-y plane of the shoe sole 100. In one implementation, a void cell is offset relative its corresponding void cell so that a portion of one of the cells is not vertically aligned with a portion of the opposing cell. In another implementation, at least one cell on the bottom matrix 108 has a larger or smaller outer perimeter than an opposing cell of the top matrix 106. In yet another implementation, void cells of a corresponding void cell pair have different dimensions and/or shapes.

In some implementations, opposing cell peaks are not in direct contact with one another. For example, the shoe sole 100 may include an interim binding layer (not shown) between the top matrix 106 and the bottom matrix 108 so that the corresponding cell peaks do not physically contact one another but are still vertically aligned.

In one implementation, the top matrix 106 has a length (e.g., y-direction) and/or width (e.g., x-direction) that are different from a corresponding length or width of the bottom matrix 108. Accordingly, an outer perimeter of the top matrix 106 may encompass a different area than an outer perimeter of the bottom matrix.

For example, the top matrix 106 may have a smaller width and a smaller length than the corresponding width and length of the to bottom matrix 108 such that the outer perimeter of the top matrix 106 encompasses a smaller total surface area than the surface area encompassed by the outer perimeter of the bottom matrix 108. In addition, the top matrix 106 may include a different number of void cells than the bottom matrix 108.

The void cells in the shoe sole 100 may be of a variety of symmetric and/or asymmetric shapes. For example, the void cells may be elliptical, circular, rectangular, triangular, or a variety of other non-traditional shapes. In some cases, individual void cells lack symmetry across one or more axes.

In one implementation, a number of the individual void cells of the top matrix 106 and/or the bottom matrix 108 are shaped to follow a curved or contoured perimeter outline that groups the void cells into a performance region. For example, the pairs of corresponding cells in the top matrix 106 and/or the bottom matrix 108 may be tightly packed in higher impact areas of the shoe sole, such as in mid-foot or heel regions.

In some implementations, some or all of the void cells have cellular walls that are angled from the vertical plane (e.g., the z-axis). The cellular walls may flare outward away from a void cell base at a draft angle (e.g., an example draft angle α shown in magnified view 120), which may reduce or eliminate a rapid collapse characteristic of the void cells under load. Draft angles of void cells in the same matrix (e.g., either within the top matrix 106 or within the bottom matrix 108) may differ from one another and/or draft angles of void cells in the top matrix 106 may differ from draft angles of void cells in the bottom matrix 108. For example, the draft angle α of the void cell 124 is different than a draft angle β of the corresponding void cell 126.

The shoe sole 100 includes cut areas (e.g., cut area 112) that separate different regions of the shoe sole 100 and provide increased flexibility of the shoe sole 100 at the cut areas. Still further, the void cells in the different regions of the shoe sole 100 may provide different compression/rebound characteristics (e.g., void cells in a heel region of the shoe sole 100 may have a higher resistance to deflection than void cells in an arch region of the shoe sole 100). Further, the different regions of the shoe sole 100 may have predefined dimensions based on desired performance characteristics of the shoe sole 100. The void cells within each predefined region may have a shape and size configured to fully fill each predefined region of the shoe sole 100 with a consistent spacing between adjacent void cells.

The shoe sole 100 also includes a number of stiffening channels (e.g., a stiffening channel 103) separating two adjacent void cells. The stiffening channels may increase the resistance to deflection of the adjacent void cells. In one implementation, the stiffening channels are oriented between perimeter void cells to provide additional support and stability at the perimeter of the shoe sole 100.

At least the material, wall thickness, size, and shape of each of the void cells define the resistive force each of the void cells can apply. Materials used for the void cells are generally elastically deformable under expected load conditions and will withstand numerous deformations without fracturing or suffering other breakdown impairing the function of the shoe sole 100. Example materials include thermoplastic urethane, thermoplastic elatomers, styrenic copolymers, rubber, Dow Pellethane®, Lubrizol Estane®, Dupont™ Hytrel®, ATOFINA Pebax®, and Krayton polymers. Further, the void cells may be cubical, pyramidal, hemispherical, or any other shape capable of having a hollow interior volume. Other shapes may have similar dimensions as the aforementioned cubical implementation. In one implementation, the top matrix 106 is constructed from a different material than the bottom matrix 108. In another implementation, the top matrix 106 is constructed from the same material as the bottom matrix 108.

In one implementation, the void cells are filled with ambient air. In another implementation, the void cells are filled with a foam or a fluid other than air. The foam or certain fluids may be used to insulate a user's body, facilitate heat transfer from the user's body to/from the shoe sole 100, and/or affect the resistance to deflection of the shoe sole 100. In a vacuum or near-vacuum environment (e.g., outer space), the hollow chambers may be un-filled.

Although the shoe sole of FIG. 1 includes two void cell matrices, other implementations may include three or more stacked void cell matrices with two or more of the void cell matrices being different from one another. In at least one implementation, some or all of peaks of the void cells in the top matrix 106 are attached to the bottom binding layer 111. In the same or another implementation, some or all of peaks of the void cells in the bottom matrix 108 are attached to the top binding layer 110.

Figure 2:
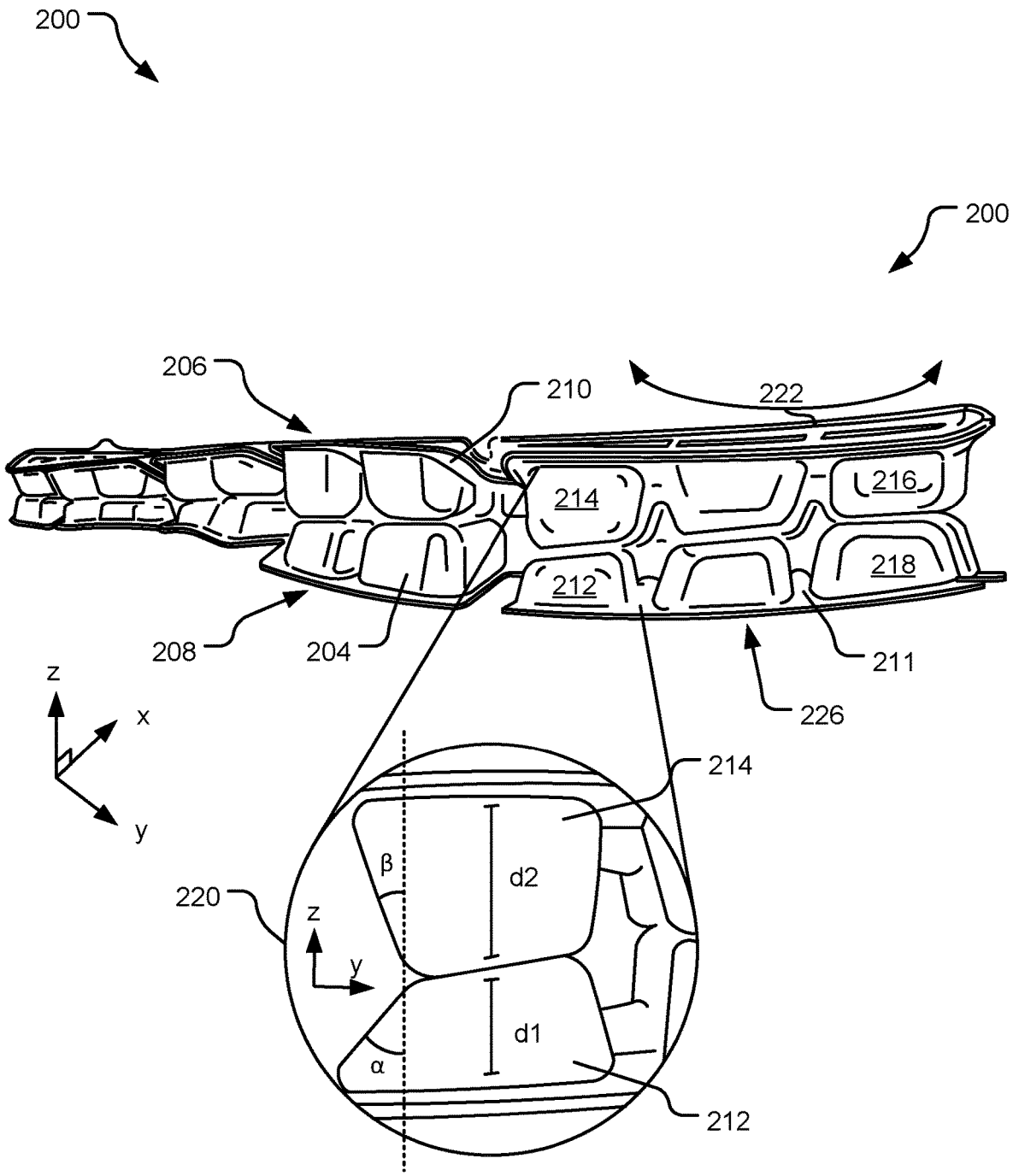
FIG. 2 illustrates a perspective view of an example shoe sole including void cells arranged in geometrically different void cell matrices.

FIG. 2 illustrates a side perspective view of an example shoe sole 200 including void cells (e.g., void cells 204, 212, 214) arranged in geometrically different void cell matrices. In particular, the shoe sole 200 includes a top matrix 206 of void cells that protrude from a common top binding layer 210 and a bottom matrix 208 of void cells that protrude from a common bottom binding layer 211. The corresponding void cells illustrated are of similar perimeter size and have peaks that are in vertical alignment so that each of the void cells corresponds to at least one other void cell.

Some individual void cells may correspond to multiple void cells on the opposing matrix. For example, one large void cell on the bottom matrix 208 may vertically align with multiple smaller void cells on the top matrix 206. In another implementation, a larger void cell of the top matrix 206 corresponds with multiple smaller void cells on the bottom matrix 208. In still another implementation, the top matrix 206 and the bottom matrix 208 have corresponding pairs of void cells that are offset from one another so that at least one void cell on either the top matrix 206 or the bottom matrix 208 corresponds to multiple void cells on the opposing matrix.

In FIG. 2, some or all of the void cells in the top matrix 206 are different from corresponding void cells of the bottom matrix 208. The top matrix 206 may include a different number void cells than the bottom matrix 208 and/or one or more void cells of the top matrix 206 may be of different sizes and/or shapes than a corresponding void cell of the bottom matrix 208. For example, magnified view 220 illustrates that a void cell 212 on the bottom matrix 208 has a first average depth (d1) and a corresponding void cell 214 on the top matrix 206 has a greater average depth (d2). According to one implementation, the depths of void cells range from between about 2 mm and 24 mm.

The ratio of corresponding cells depths (e.g., d1/d2) may vary based on the location of each individual void cell within the shoe sole 200 relative to the foot and/or based on performance design criteria, such as a desired range of motion, compression, etc. In some uses one side of a void cell may be designed to collapse before an opposite side of the void cell to provide stability to the foot or to specific areas of the foot. This selective collapsibility can be accomplished in a variety of ways, such as by forming one side of the void cell to be longer and/or deeper than the other. The force required to buckle (e.g., collapse) the side of the void cell decreases in proportion to length (or depth), so the longer side may buckle before the shorter side. In addition, certain manufacturing processes, such as thermoforming, may lead to thinner void cell walls on sides of the void cell that are longer (or deeper) than other sides. Thinner walls may buckle under a force less than a force sufficient to buckle thicker walls.

Corresponding void cells may have draft angles that are different from one another. For example, the draft angle (α) of void cell 212 is greater than a draft angle (β) of the corresponding void cell 214. In one implementation, draft angles of different void cells differ depending on the area of the shoe sole 200 where the void cell is positioned. For example, different void cell draft angles can be used to provide different compression/rebound characteristics in different areas of the shoe. According to one implementation, the draft angles of various void cells range from between about 3 and 45 degrees. The x-y plane of the shoe sole 200 (hereinafter referred to as the "sole plane") is a plane substantially parallel to a base 226 of the shoe sole when placed on a flat surface.

The outer perimeter of the top matrix 206 and/or the bottom matrix 208 may include a flared flange portion that angles away from the sole plane. For example, the top matrix 206 has a perimeter edge 222 that flares upward on all sides (as indicated by the double-headed arrow). This feature may provide additional stability control that may mitigate over-pronation a user's foot and/or promote bonding between the shoe sole 300 and a shoe upper.

Figure 3:
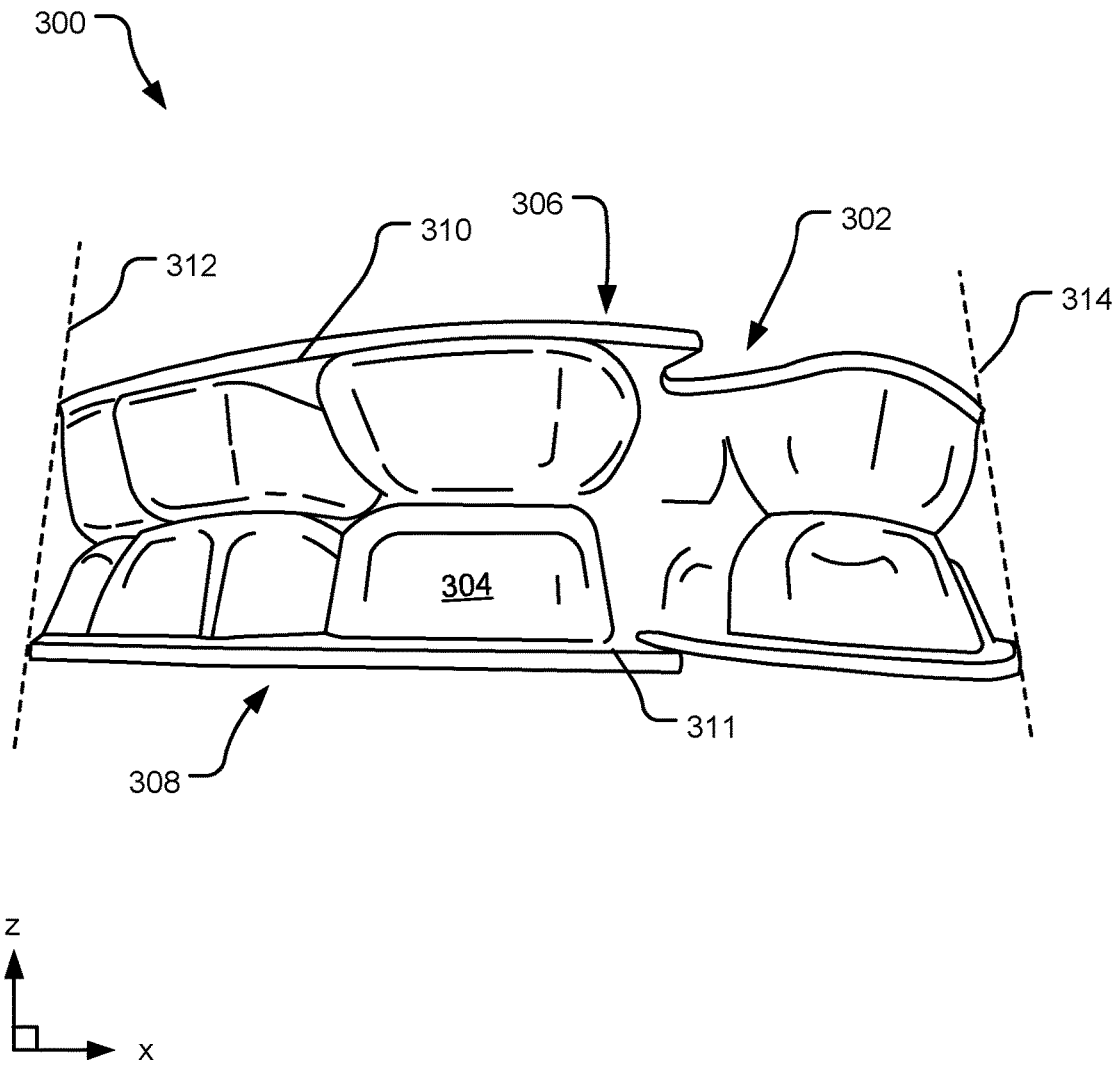
FIG. 3 illustrates a rear elevation view of an example shoe sole including void cells arranged in geometrically different void cell matrices.

FIG. 3 illustrates a rear elevation view of an example shoe sole 300 including void cells (e.g., void cell 304) arranged in multiple differing void cell matrices. In particular, the shoe sole 300 includes a top matrix 306 of void cells that protrude from a common top binding layer 310 and a bottom matrix 308 of void cells that protrude from a common bottom binding layer 311.

The arrangement of void cells in the top matrix 306 differs from the arrangement of void cells in the bottom matrix 308. For example, the top matrix 306 may include a different number void cells than the bottom matrix 308 and/or one or more void cells of the top matrix 306 may be of different sizes and/or shapes than corresponding void cells of the bottom matrix 308.

In addition, perimeter dimensions of the top matrix 306 differ from perimeter dimensions of the bottom matrix 308. More specifically, a width dimension of the top matrix 306 is less than a width dimension of the bottom matrix 308, as evidenced by cut lines 312, 314, which are not vertically oriented. This is referred to herein as offset cut lines. In various implementations, the offset cut lines are angled 10-20 degrees from vertical.

Some or all of peaks of the void cells in the top matrix 306 are attached to corresponding peaks of the void cells in the bottom matrix 308 to form the shoe sole 300. Further, the shoe sole 300 includes cut areas (e.g., cut area 302) that separate different regions of the shoe sole 300 and provide increased flexibility of the shoe sole 300 at the cut areas. Still further, the void cells in the different regions of the shoe sole 300 may provide different compression/rebound characteristics (e.g., void cells in a heel region of the shoe sole 300 may have a higher resistance to deflection than void cells in an arch region of the shoe sole 300).

Figures 4A, 4B:
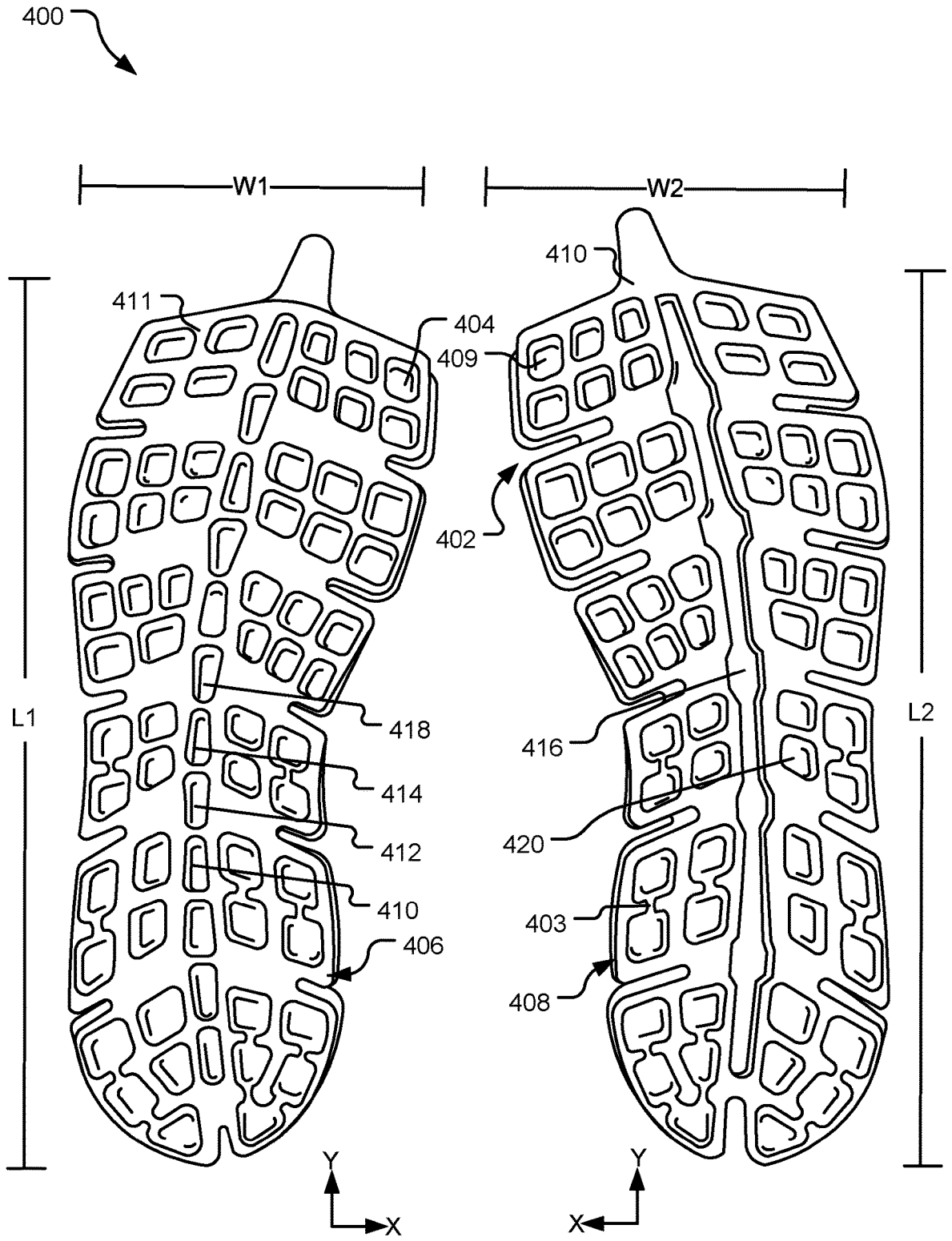
FIG. 4A illustrates a first void cell matrix forming a first portion of a shoe sole.
FIG. 4B illustrates a second void cell matrix forming another portion of a shoe sole.

FIGS. 4A and 4B illustrate differing void cell matrices forming different portions of a shoe sole 400. FIG. 4A illustrates a plan view of a top surface of a top matrix 406 including void cells protruding from a common upper binding layer 411. FIG. 4B illustrates a plan view of a bottom surface of a bottom matrix 408 of void cells protruding from a common lower binding layer 410. In the implementation shown, all of the void cells in FIGS. 4A and 4B protrude in a z-direction into the page. When the top matrix 406 and the bottom matrix 408 are implemented in the same shoe sole, the void cell peaks of the top matrix 406 rest adjacent to (e.g., contact) the void cell peaks of the bottom matrix 408, and the surface illustrated in FIG. 4A faces a direction opposite from the surface illustrated in FIG. 4B. In another implementation, the void cell peaks of the top matrix 406 do not contact the void cell peaks of the bottom matrix 408. For example, there may be an interface layer separating corresponding void cell peaks and/or there may be a space between corresponding void cell peaks.

Some void cells in the bottom matrix 408 correspond with exactly one void cell in the top matrix 406. For example, the void cells 404 and 409 form an exclusive corresponding void cell pair. However, other void cells in the bottom matrix 408 correspond with more than one void cell in the top matrix 406. For example, an elongated, extended void cell 416 corresponds to a number of discrete void cells (e.g., void cells 410, 412, 414, 418, etc.) extending along a center portion of the top matrix 406 in a ridge-like fashion. As a result, the multiple discrete void cells may provide improved support to a user of the shoe sole 400, and the extended void cell 416 may provide increased flexibility of the shoe sole 400 in one or more directions. For example, the extended void cell 416 may provide for increased flexibility across a longitudinal (e.g., y-direction) axis of the shoe sole 400. Other implementations include a variety of other void cell arrangements including individual void cells that corresponding to multiple void cells. For example, a large, rectangular-shaped void cell may correspond to two or more smaller void cells of the opposing matrix.

Perimeter dimensions of the top matrix 406 differ from perimeter dimensions of the bottom matrix (i.e., the shoe sole 400 incorporates offset cut lines). In one implementation, a bottom array of void cells has larger perimeter dimensions to promote stability of a shoe sole incorporating the aforementioned void cell structure. A top array of void cells has smaller perimeter dimensions to closely match with dimensions of a user's foot. For example, a width W1 of the top matrix 406 is smaller than a corresponding width W2 of the bottom matrix 408. In addition, a length L1 of the top matrix 406 is smaller than a length L2 of the bottom matrix 408. Accordingly, a total surface area in the sole plane (e.g., the x-y plane) of the top matrix 406 is less than the total surface area in the sole plane of the bottom matrix 408.

In some implementations, one or more void cells of the top matrix 406 have a different perimeter or depth than a corresponding void cell of the bottom matrix 408. The void cells may be a variety of shapes, such as elliptical, circular, rectangular, triangular, or a variety of other non-traditional shapes. One or more void cells in the shoe cell may have an asymmetrical perimeter. For example, the void cell 420 is asymmetric with four sidewalls of variable lengths. Some voids cells, such as the void cell 414 in the top matrix 406, are symmetric across a first axis (e.g., an axis in the y-direction), but lack symmetry across another axis (e.g., an axis in the x-direction).

Further, the shoe sole 400 includes cut areas (e.g., cut area 402) that separate different regions of the shoe sole 400 and provide increased flexibility of the shoe sole 400 at the cut areas. Still further, the void cells in the different regions of the shoe sole 400 may provide different compression/rebound characteristics (e.g., void cells in a heel region of the shoe sole 400 may have a higher resistance to deflection than void cells in an arch region of the shoe sole 400). Further still, one or more stiffening channels (e.g., stiffening channel 403) may be incorporated into an area separating two void cells. The stiffening channels may increase the resistance to deflection of the adjacent void cells. In various implementations, the outer perimeter dimensions of the top matrix 406 and/or the bottom matrix 408 leave substantial binding layer material outside perimeter void cells to aid attachment to other components of the layered void cell structure.

In another implementation, the bottom matrix 408 may be made of an abrasion-resistant material, incorporate an abrasion-resistant coating, or have an abrasion-resistant layer applied over the void cells. If an abrasion-resistant layer is used, it may be cut-out or otherwise perforated to avoid sealing the bottom-facing void cells. Further, the abrasion-resistant material may also enhance traction with an adjacent surface. The abrasion-resistant material allows the bottom matrix 408 to be used as a traction surface for the shoe sole 400.

Figure 5:
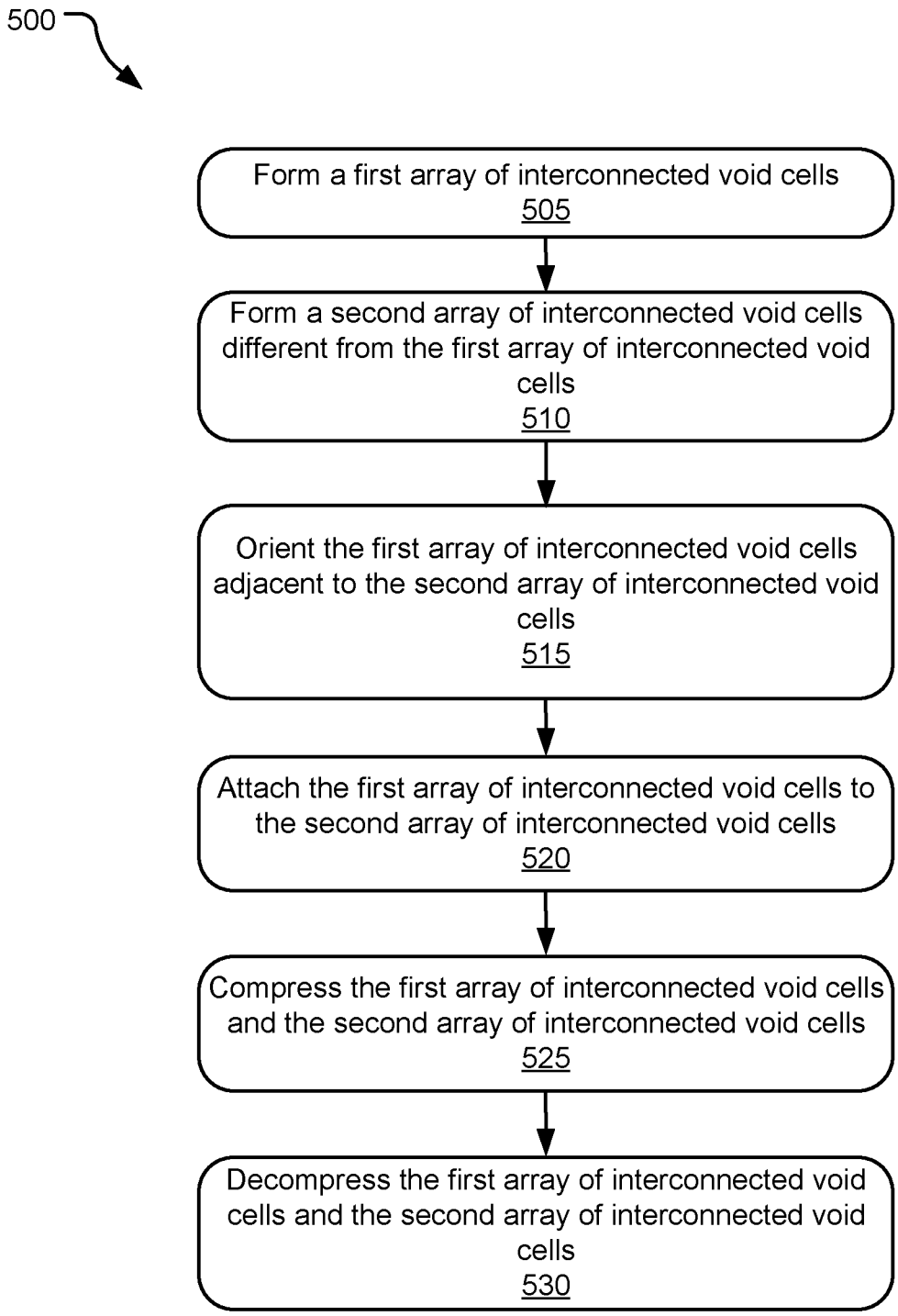
FIG. 5 illustrates example operations for forming a shoe sole with differing void cell matrices.

FIG. 5 illustrates example operations 500 for forming a shoe sole with differing void cell matrices. A first forming operation 505 forms a first array of interconnected void cells protruding from a first common binding layer. A second forming operation 510 forms a second array of void cells protruding from a second common binding layer. Suitable forming operations include, for example, blow molding, thermoforming, extrusion, injection molding, laminating, etc.

Each of the void cells in the first array and the second array has a predefined geometry. Corresponding void cells may be identical or different from one another. In one implementation, the first array of interconnected void cells has a different number of void cells than the second array of interconnected void cells. In another implementation, the interconnected void cell matrices include one or more corresponding void cells that are different sizes, shapes, and/or draft angles. In still another implementation, the interconnected void cell matrices have outer perimeters of different sizes. Further, one or more void cells may have an asymmetrical perimeter.

An orientation operation 515 orients the first array of interconnected void cells adjacent to the second array of interconnected void cells. An attachment operation 520 attaches peaks of multiple void cells protruding from the first array of interconnected void cells to peaks of void cells protruding from the second array of interconnected void cells. In another attachment operation, peaks of multiple void cells of one array of interconnected void cells are attached to the binding layer of the opposite array of interconnected void cells.

A compression operation 525 applies a contact force to compress the first and second arrays of interconnected void cells, deforming one or more cells. A decompression operation 530 removes the compression force, allowing the compressed void cells to rebound to an original shape and position.

The logical operations making up the embodiments of the invention described herein are referred to variously as operations, steps, objects, or modules. Furthermore, it should be understood that logical operations may be performed in any order, adding or omitting steps as desired, unless explicitly claimed otherwise or a specific order is inherently necessitated by the claim language.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A void cell arrangement comprising:

a first void cell matrix including a first array of void cells interconnected by a first binding layer oriented adjacent to a second opposing void cell matrix including a second array of void cells interconnected by a second binding layer, wherein a volume between the first binding layer and the second binding layer is open to atmosphere, wherein the second array of interconnected void cells is geometrically different from the first array of interconnected void cells, wherein an outer perimeter dimension of the second array of interconnected void cells is different than an outer perimeter dimension of the first array of interconnected void cells, and wherein the second opposing array of interconnected void cells includes at least one void cell that opposes an entirety of multiple void cells of the first array of interconnected void cells.

2. The void cell arrangement of claim 1, wherein the first array of interconnected void cells includes at least one void cell that is different from a corresponding void cell of the second opposing array of interconnected void cells.

3. The void cell arrangement of claim 1, wherein at least one void cell has an asymmetrical perimeter.

4. The void cell arrangement of claim 1, wherein a depth of a void cell of the first array of interconnected void cells is different from a depth of a corresponding void cell of the second opposing array of interconnected void cells.

5. The void cell arrangement of claim 1, wherein the void cell arrangement includes offset cut lines.

6. The void cell arrangement of claim 1, wherein a draft angle of at least one void cell is different from a draft angle of another void cell.

7. The void cell arrangement of claim 1, wherein the void cells of the first array and the void cells of the second array are open to atmosphere.

8. A method comprising:

orienting a first void cell matrix including a first array of void cells interconnected by a first binding layer adjacent to a second opposing void cell matrix including a second array of void cells interconnected by a second binding layer, wherein a volume between the first binding layer and the second binding layer is open to atmosphere, wherein the second array of interconnected void cells is geometrically different from the first array of interconnected void cells, wherein an outer perimeter dimension of the entire second array of interconnected void cells is different than an outer perimeter dimension of the entire first array of interconnected void cells, and wherein the second opposing array of interconnected void cells includes at least one void cell that opposes an entirety of multiple void cells of the first array of interconnected void cells; and attaching one or more peaks of the interconnected void cells of the first array to one or more corresponding peaks of the interconnected void cells of the second array.

9. The method of claim 8, wherein the first array of interconnected void cells includes at least one void cell that is different from a corresponding void cell of the second opposing array of interconnected void cells.

10. The method of claim 8, wherein at least one void cell has an asymmetrical perimeter.

11. The method of claim 8, wherein at least one of the void cells of the first array of interconnected void cells has different dimensions than a corresponding void cell of the second opposing array of interconnected void cells.

12. The method of claim 8, wherein a depth of a void cell of the first array of interconnected void cells is different from a depth of a corresponding void cell of the second opposing array of interconnected void cells.

13. The method of claim 8, wherein a draft angle of at least one void cell is different from a draft angle of another void cell.

14. The method of claim 8, wherein the void cells of the first array and the void cells of the second array are open to atmosphere.

15. A void cell arrangement comprising:

a first array of interconnected void cells; and a second array of interconnected void cells adjacent to and opposing the first array of interconnected void cells, wherein a volume between the first binding layer and the second binding layer is open to atmosphere, wherein at least one void cell of the second array of interconnected void cells is different from a corresponding void cell of the first array of interconnected void cells, and wherein the second array of interconnected void cells includes at least one void cell that opposes an entirety of multiple void cells of the first array of interconnected void cells.

16. The void cell arrangement of claim 15, wherein the first array of interconnected void cells is attached to the second opposing array of interconnected void cells at one or more peaks of corresponding void cells.

17. The void cell arrangement of claim 15, wherein the outer perimeter dimension of the first array of interconnected void cells is different than the outer perimeter dimension of the second array of interconnected void cells.

18. The void cell arrangement of claim 15, wherein at least one void cell has an asymmetrical perimeter.

* * * * *